US008739326B2

(12) United States Patent
Stäubli

(10) Patent No.: US 8,739,326 B2
(45) Date of Patent: Jun. 3, 2014

(54) MOUNTING DEVICE HAVING A MOUNTING FRAME WITH SECURING RAIL, AND METHOD OF MOUNTING A MOUNTING DEVICE

(75) Inventor: Tom Stäubli, Zürich (CH)

(73) Assignee: Geberit International AG, Jona (CH)

( * ) Notice: Subject to any disclaimer, the term of this patent is extended or adjusted under 35 U.S.C. 154(b) by 139 days.

(21) Appl. No.: 13/181,086

(22) Filed: Jul. 12, 2011

(65) Prior Publication Data

US 2012/0012720 A1 Jan. 19, 2012

(30) Foreign Application Priority Data

Jul. 14, 2010 (EP) ..... 10405137

(51) Int. Cl.
*A47K 1/05* (2006.01)
*E03C 1/32* (2006.01)

(52) U.S. Cl.
USPC ..... 4/643; 248/475.1; 248/220.21; 4/252.2; 4/647; 4/648

(58) Field of Classification Search
USPC ..... 248/217.1, 220.21, 222.4, 232, 240.1, 248/247, 475.1, 466; 4/252.2, 253, 353, 4/661, 901, 643, 645, 646, 647, 648, 649
See application file for complete search history.

(56) References Cited

U.S. PATENT DOCUMENTS

| | | | | |
|---|---|---|---|---|
| 3,924,279 | A * | 12/1975 | Morris et al. | 4/252.2 |
| 5,961,082 | A * | 10/1999 | Walter | 248/220.21 |
| 6,035,589 | A * | 3/2000 | Schmucki et al. | 52/126.1 |
| 6,545,214 | B2 * | 4/2003 | Russell et al. | 174/497 |
| 6,631,813 | B1 * | 10/2003 | Walter et al. | 211/94.01 |
| 2006/0102813 | A1 * | 5/2006 | Hetzler et al. | 248/127 |
| 2010/0065699 | A1 * | 3/2010 | Tremp | 248/205.3 |

FOREIGN PATENT DOCUMENTS

| | | | |
|---|---|---|---|
| DE | 2 511 775 | A1 | 9/1976 |
| DE | 82 02 368 | U1 | 5/1982 |
| DE | 197 09 463 | A1 | 9/1998 |
| DE | 299 03 019 | U1 | 5/1999 |
| DE | 10 2008 045836 | A1 | 3/2010 |
| EP | 2 166 163 | A1 | 3/2010 |

OTHER PUBLICATIONS

European Search Report of EP 10405137, Dated Dec. 16, 2010.

* cited by examiner

*Primary Examiner* — Nkeisha Smith
(74) *Attorney, Agent, or Firm* — Sughrue Mion, PLLC

(57) ABSTRACT

The mounting device includes a mounting frame (6) on which there is set a front cladding (2). Through the front cladding (2) there pass securing means (4) anchored to a cross piece (5) of the mounting frame (6), for securing a sanitary element (3). The front cladding (2) comprises at least an upper part (8) and a lower part (9) which are plate-shaped. Between the two parts (8, 9) there is a gap (16) in which there is arranged a securing rail (25) through which the said securing means (4) pass. The two parts (8, 9) can be aligned on the securing rail (4) during mounting.

14 Claims, 3 Drawing Sheets

Figure 1:
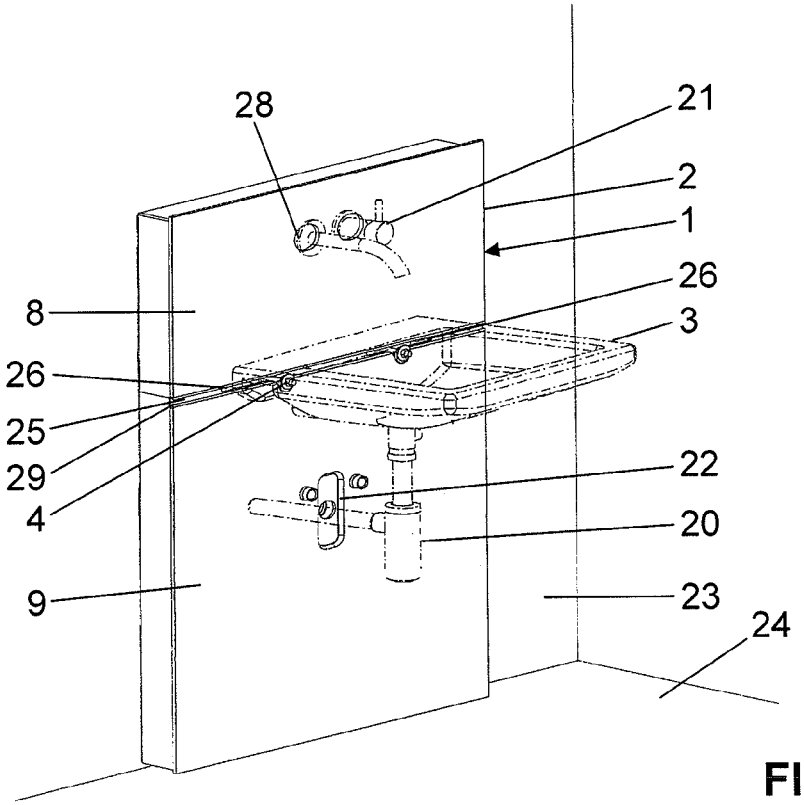

MOUNTING DEVICE HAVING A MOUNTING FRAME WITH SECURING RAIL, AND METHOD OF MOUNTING A MOUNTING DEVICE

The invention relates to a mounting device having a mounting frame on which there is set a front cladding through which there pass securing means anchored to a cross piece of the mounting frame, for securing a sanitary element.

A mounting device of the type mentioned has been disclosed in the prior art by EP-A-2 166 163, belonging to the Applicant. This serves to mount a toilet bowl. For securing the toilet bowl, a mounting frame is provided, on which a plate-shaped cover which hides the mounting frame at least at the front is arranged. The front cladding is provided with apertures through which there pass threaded rods to which the toilet bowl is secured.

DE-A-25 11 775 discloses a mounting device which is provided for modernizing old buildings and in which the mounting frame is covered by a cladding shell. For securing a wash basin, and for the connection thereof, the cladding shell has various openings for stud bolts to pass through. The cladding shell is made from two parts that are pushed over one another in the manner of a telescope, for adapting it to different heights between storeys.

DE-A-197 09 463 discloses a securing system for mounting in front of a wall, this mounting being provided with a mounting aid having two cross pieces to which a base plate is secured. The base plate has apertures for securing a sanitary element.

The object of the invention is to provide a mounting device of the said type which enables mounting to be even simpler and yet secure.

The object is achieved in the case of a mounting device of the generic type in that the front cladding comprises at least an upper and a lower part which are plate-shaped and between which there is a gap in which there is arranged a securing rail through which the said securing means pass. In the mounting device according to the invention, no apertures for the securing means of the sanitary element are thus required in the front cladding. All that is required here are apertures for any fittings or for example for connecting an odour trap. The securing rail makes it possible to align the two parts of the front cladding simply and precisely. In this arrangement, the upper part can be brought into position against the securing rail from above and the lower part from below. Also conceivable is a construction having more than one securing rail. For example, three securing rails and, correspondingly, three plate-shaped parts may be provided.

According to a further development of the invention, it is provided for the cross piece and the securing rail to run substantially parallel to one another. The cross piece and the securing rail may be separately manufactured parts. The cross piece may for example—as is conventional per se—be made inexpensively from an angled sheet-metal profile. The securing rail may be made from a different material, which also meets high demands from an aesthetic point of view. In principle, an embodiment in which the cross piece and the securing rail are made in one piece from an elongate part is also conceivable. Also conceivable is an embodiment in which the securing rail is injection-moulded onto the cross piece. The cross piece and the securing rail may then be made from different materials. Preferably, the securing rail is arranged in front of the cross piece. The securing rail and the cross piece may be connected to one another, for example with securing screws.

According to a further development of the invention, it is provided for the said gap to be formed by a lower shorter side of the upper part and an upper shorter side of the lower part. These two shorter sides are preferably arranged parallel and at a spacing from one another. The spacing may vary, for example being 1 to 5 cm. Other sizes of spacing are however also conceivable.

According to a further development of the invention, it is provided for the securing rail to be longer than the cross piece and to project beyond it on at least one side. This makes it possible to make a mounting device having a front cladding wider than the width of the mounting frame. Thus, the mounting frame provides the possibility of a cover having different widths.

According to a further development of the invention, and in addition to the purpose of securing a sanitary element, it is provided for the securing rail to be provided for the purpose of securing an additional part, for example a soap dish. An additional part of this kind may be mounted on this securing rail particularly simply and where necessary may also be exchanged or replaced. This is possible in a particularly simple manner if, according to a further development of the invention, the securing rail is substantially C-shaped in cross section. The additional part may then be latched onto the securing part from the front, for example, or pushed into it from the side. It is also possible in that case for blanking panel parts to be secured to the securing rail in a simple manner. Where appropriate, these may then also be exchanged in a simple manner.

In the method according to the invention, it is in particular provided for the upper part and the lower part of the front cladding to be aligned on the mounted securing rail. During mounting, the mounting frame is mounted in front of the wall or flush with the plaster. In this case, the cross piece and the securing rail may already be mounted beforehand. Subsequent mounting, in particular of the securing rail, is also entirely conceivable, however. After alignment of the securing rail, the two parts of the front cladding may be aligned on the securing rail and secured to the mounting frame. In the case of mounting in front of the wall, it is moreover provided for the cladding to be supplemented by side parts which may extend vertically and horizontally. Once the cladding is mounted, the sanitary element may be mounted on the securing means, for example threaded rods, which pass through the securing rail and are anchored to the cross piece. Anchoring is performed for example using T-slots which are inserted in a channel in the cross piece. Once the sanitary element has been secured, where appropriate additional parts may also be secured to the securing rail. The method is suitable for front cladding made of various materials, for example glass, stone, plastics, wood or metal.

Further advantageous features will be apparent from the dependent claims, the description which follows and the drawing.

Figure 2:
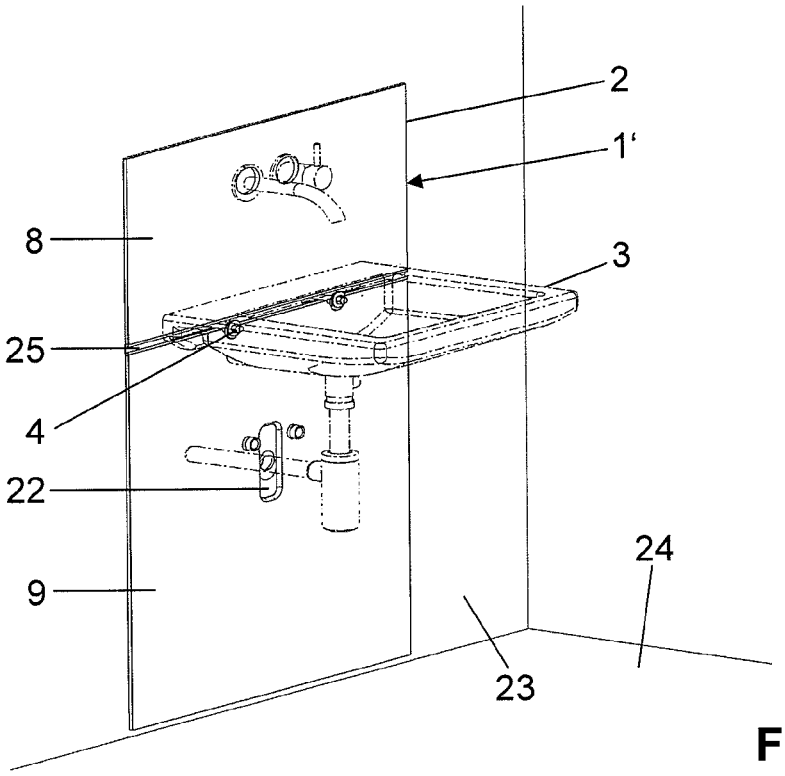
Figure 3:
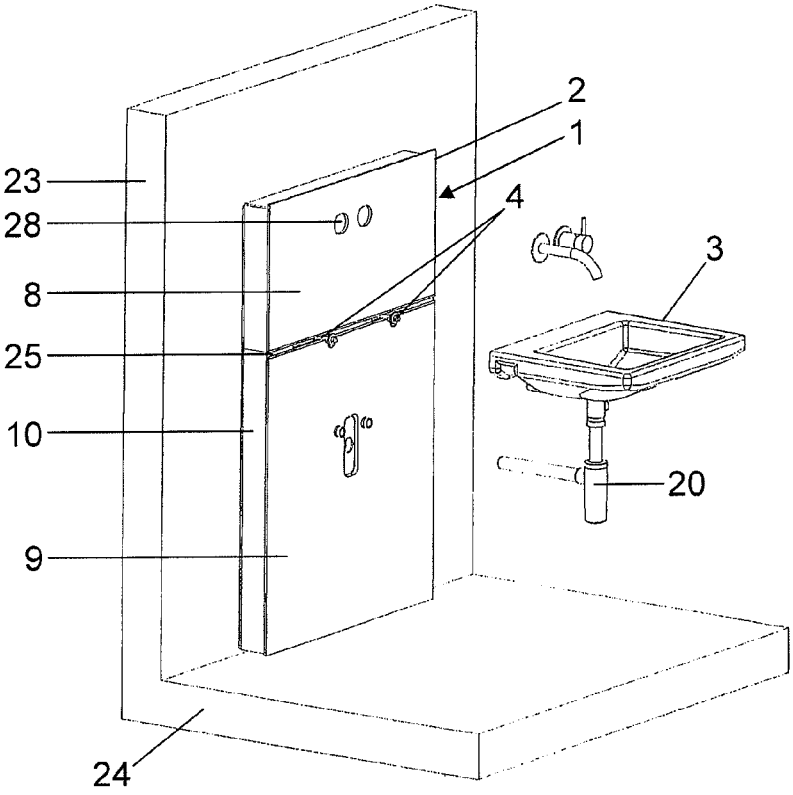
Figure 4:
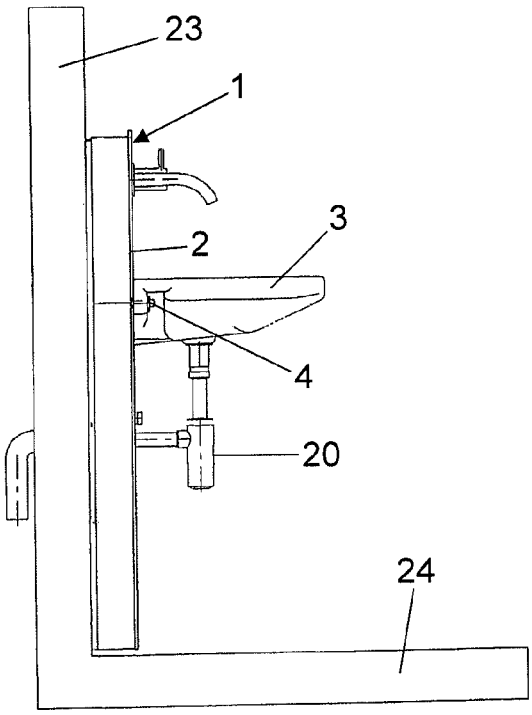
Figure 5:
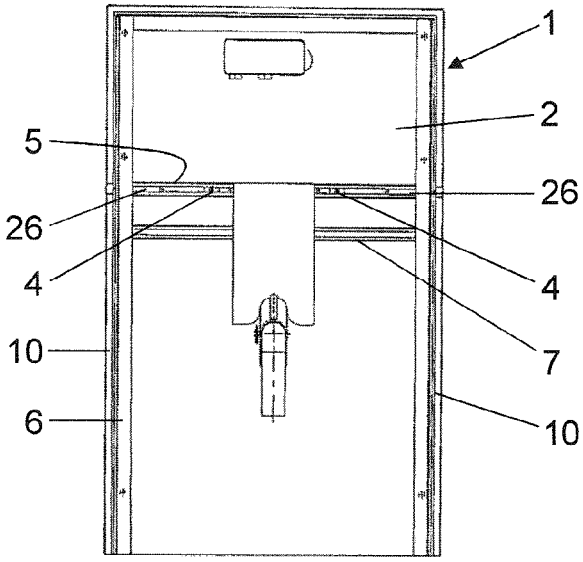
Figure 6:
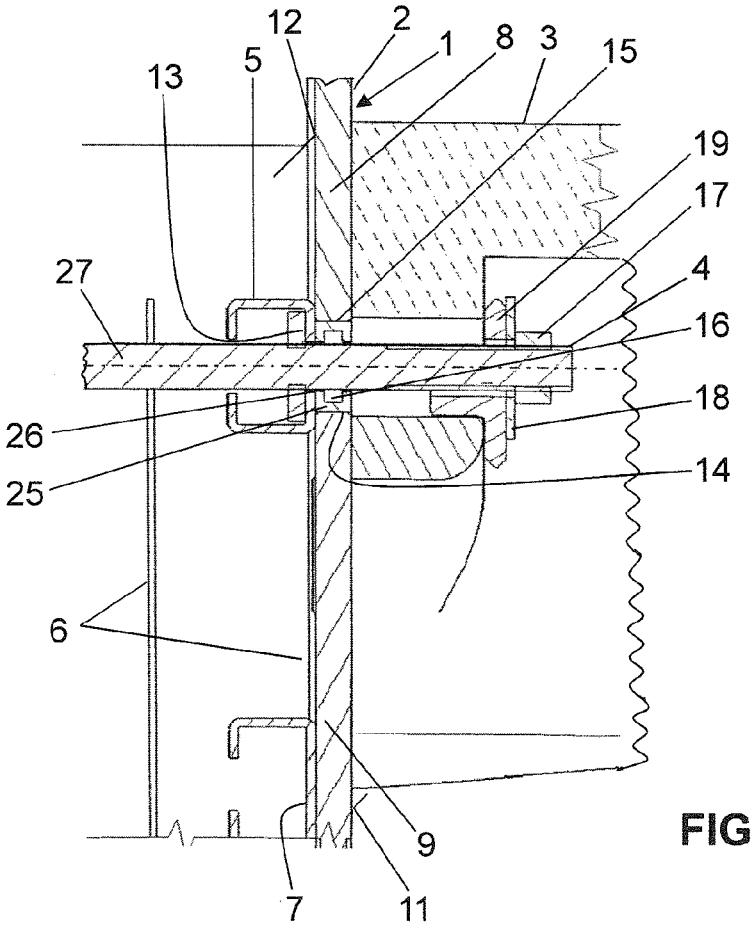

Exemplary embodiments of the invention will be explained in more detail below with reference to the drawing, in which:

FIG. 1 shows a perspective view of a mounting device as mounted in front of a wall, FIG. 2 shows a perspective view of a mounting device according to the invention as mounted flush with the plaster, FIG. 3 shows a further view of the mounting device according to FIG. 1, FIG. 4 shows a side view of the mounting device according to FIG. 1, FIG. 5 shows a view of the rear of the mounting device according to FIG. 1, and FIG. 6 shows a vertical section through part of the mounting device.

The mounting device 1 shown in FIG. 1 is a mounting device for mounting in front of a wall, and is arranged in front of a building wall 23 and is set on a building floor 24. It serves to secure a sanitary element 3, illustrated here in dot-and-dash lines. The latter is a wash basin having an odour trap 20. Provided above the wash basin or sanitary element 3 is a fitting 21, also illustrated in dot-and-dash lines, which forms a water tap. However, another sanitary element is also conceivable here instead of a wash basin.

The mounting device 1 has a front cladding which has an upper part 8 and a lower part 9. These two parts 8 and are plate-shaped and are preferably but not necessarily rectangular. The parts 8 and 9 may be made from the same or different materials. Conceivable materials are for example glass, stone, plastics or indeed other suitable materials. Arranged between the two parts 8 and 9 is a securing rail 25 which extends over the entire width of the front cladding 2. As shown in FIG. 6, the two parts 8 and 9 abut, in each case by means of a shorter side 15 and 14 respectively, against this securing rail 25. As shown in FIG. 6, the parts 8 and 9 are of substantially the same width as the securing rail 25. Preferably, the securing rail 25 extends horizontally.

The securing rail 25 has two respective slots 26, each of which is passed through by a threaded rod 27 (FIG. 6). As shown in particular by FIG. 6, the threaded rods 27, each having a threaded nut 17, a washer 18, a holding part 19 and a T-slot 13, form securing means 4. These securing means 4 are used to secure the sanitary element 3 to the mounting device 1.

Behind the securing rail 25 there runs a cross piece 5 which as shown in FIG. 5 is secured to a mounting frame 6. The cross piece 5 is secured to the mounting frame 6 by means of securing screws, latching means or the like (not shown here). It may be vertically adjustable. The mounting frame 6 may comprise vertical and horizontal parts, as is conventional. Moreover, a further cross piece 7 is provided here, arranged at a spacing from and below the cross piece 5. In the case of the mounting device 1' according to FIG. 2, the mounting frame is arranged in a recess in the building wall 23. The mounting frame 6 may be of various constructions. The only essential point is that the cross piece 5 is held in a stable manner. In the case of the mounting device 1 according to FIG. 1, the mounting frame 6 is arranged in front of the building wall 23.

As shown in FIG. 6, the two parts 8 and 9 are brought into position with a rear side 12 against the cross pieces 5 and 7 and are supported thereon. The two parts and 9 also abut against the other parts of the mounting frame 6. Moreover, in the mounted condition, the sanitary element 3 abuts by means of a rear side against a front side 11 of the front cladding 2 and presses the latter against the mounting frame 6. As FIG. 6 shows, the cross piece 5 and also the securing rail 25 are C-shaped in cross section. The cross piece 5 is open to the rear, whereas the securing rail 25 is open to the front and preferably also to the side. The abovementioned slots 26 make it possible to adjust the spacing between the two threaded rods 27 continuously variably. As seen in FIG. 5, the cross piece 5 has corresponding slots 26. This makes it possible to adjust to different sanitary elements 3 in a simple manner.

The securing rail 25 projects laterally beyond the sanitary element 3. A front slit 29 in the securing rail 25 is visible in each case in the projecting regions. A blanking panel (not shown here) may be pushed into the securing rail 25 to cover this. The slit 29 may be used moreover to secure an additional part (accessory), for example a soap dish, device, means of hanging up a towel, illumination means or the like. The corresponding securing means may be pushed laterally into the securing rail 25 or be latched on from the front. This makes it possible in particular to replace the corresponding additional parts quickly and simply and to mount them in a simple manner. The securing rail 25 and the blanking panel, if there is one, also make a contribution from an aesthetic point of view, since they make possible a very wide range of variations in colour and material. The securing rail 25 may moreover include means of illumination or itself be illuminated. If the mounting device 1 is a mounting device for mounting in front of a wall, then preferably side parts 10 which cover the mounting frame 6 to the side and the top are provided. The front cladding 2 may project beyond these side parts 10 to the side and the top. The mounting device 1 shown is provided in each case for one sanitary element 3. However, an embodiment in which two or more sanitary elements 3 are secured to the mounting device 1 or 1' is also conceivable. These sanitary elements 3 may be the same or different.

As shown in FIG. 6, the two abovementioned shorter sides 14 and 15 of the parts 8 and 9 form a gap 16 which preferably extends horizontally and in which the securing rail 25 runs. Preferably, the width of the securing rail 25 is substantially the same as the thickness of the parts 8 and 9.

The method of mounting is explained in more detail below.

In a first mounting step, the mounting frame 6 is installed in a manner known per se. In this case, the cross piece 5 may be mounted on the mounting frame 6 beforehand. This is also true of the securing rail 25. However, it is also possible for the latter to be secured to the mounting frame 6 subsequently, after the latter has been set up. The mounting frame 6 and the securing rail 25 are aligned precisely such that in particular the securing rail 25 runs horizontally. The two parts 8 and 9 are then brought into position with their respective shorter sides 14 and 15 against the securing rail 25 and are thus aligned in a corresponding manner. The sanitary element 3 is then secured to the mounting device 1 or 1' using the securing means 4. Then, the odour trap 20 is connected in a manner known per se, and finally the fitting 21 is mounted. Corresponding apertures 22 and 28 are provided in the part 9 and the part 8 respectively for connecting the odour trap 20 and the fitting 21.

LIST OF REFERENCE MATERIALS

1 Mounting device
2 Front cladding
3 Sanitary element
4 Securing means
5 Cross piece
6 Mounting frame
7 Cross piece
8 Upper part
9 Lower part
10 Side part
11 Front side
12 Rear side
13 T-slot
14 Shorter side
15 Shorter side
16 Gap
17 Nut
18 Washer
19 Holding part
20 Odour trap
21 Fitting
22 Aperture

23 Building wall
24 Building floor
25 Securing rail
26 Slot
27 Threaded rod
28 Aperture
29 Slit

The invention claimed is:

1. A mounting device comprising
a mounting frame having a cross piece,
a front cladding which is set on the mounting frame,
a securing means for securing a sanitary element which securing means passes through said front cladding and is anchored to said cross piece of the mounting frame, and
a securing rail,
wherein the front cladding comprises at least an upper part and a lower part which are plate-shaped and between which there is a gap in which there is arranged said securing rail,
wherein from said cross piece said securing means passes through said securing rail and through the gap between said parts of said front cladding,
wherein said securing rail is arranged flush with regard to a front side of the plate-shaped front cladding,
wherein the cross piece and the securing rail are in the form of separate parts, and
wherein the securing rail defines a width and wherein the front cladding defines a width, said width of the securing rail is substantially the same as said width of the front cladding.

2. The mounting device according to claim 1, wherein the cross piece and the securing rail run substantially parallel to one another.

3. The mounting device according to claim 1, wherein the securing rail is arranged in front of the cross piece.

4. The mounting device according to claim 1, wherein the gap is formed by a lower shorter side of the upper part and an upper shorter side of the lower part.

5. The mounting device according to claim 4, wherein the shorter sides are preferably arranged parallel to and at a spacing from one another.

6. The mounting device according to claim 1, wherein the securing rail is longer than the cross piece and projects beyond it on at least one side.

7. The mounting device according to claim 1, wherein in addition for securing a sanitary element, the securing rail is moreover provided to secure an additional object.

8. The mounting device according to claim 7, wherein the object is a soap dish.

9. The mounting device according to claim 1, wherein the mounting device is a device mounted in front of a wall or flush with plaster.

10. The mounting device according to claim 1, wherein the securing rail is substantially C-shaped in cross section.

11. The mounting device according to claim 1, wherein the securing rail has a slit at its front.

12. A method of mounting a mounting device according to claim 1, wherein the upper part and/or the lower part of the front cladding is/are aligned on the securing rail that is mounted onto the mounting frame before the mounting frame is secured.

13. The method according to claim 12, wherein additional objects, such as a soap dish, devices, illumination means are secured to the securing rail.

14. The method according to claim 13, wherein the objects comprise at least one of a soap dish, devices and illumination means.

* * * * *